US008529283B1

(12) United States Patent
Carden

(10) Patent No.: US 8,529,283 B1
(45) Date of Patent: Sep. 10, 2013

(54) UNIVERSAL SERIAL BUS (USB) CONNECTOR HAVING POSITIVE RETENTION

(75) Inventor: Scott Carden, Madison, AL (US)

(73) Assignee: Adtran, Inc., Huntsville, AL (US)

( * ) Notice: Subject to any disclaimer, the term of this patent is extended or adjusted under 35 U.S.C. 154(b) by 0 days.

(21) Appl. No.: 13/401,192

(22) Filed: Feb. 21, 2012

(51) Int. Cl.
*H01R 13/625* (2006.01)

(52) U.S. Cl.
USPC ..... 439/347; 439/352; 439/367; 439/368

(58) Field of Classification Search
USPC ..... 439/347, 350–353, 355, 357, 358, 439/367, 368, 369
See application file for complete search history.

(56) References Cited

U.S. PATENT DOCUMENTS 6,619,976 B2 9/2003 Huetter et al.
6,923,685 B2 * 8/2005 Holmes et al. ..... 439/660
7,128,595 B2 10/2006 Boutros
7,465,181 B1 12/2008 Bridges et al.
7,484,991 B1 2/2009 Kelaher et al.
2007/0207646 A1 9/2007 Tsuji
2010/0151720 A1 6/2010 Lin
2011/0008986 A1 1/2011 Thom et al.

FOREIGN PATENT DOCUMENTS

KR 10-2010-0131925 A 12/2010

* cited by examiner

*Primary Examiner* — Ross Gushi
(74) *Attorney, Agent, or Firm* — Smith Risley Tempel Santos LLC; Michael J. Tempel

(57) ABSTRACT

A lockable connector includes a receptacle having an opening located on an engagement surface and a spring clip slidably attached to the receptacle, the spring clip having a plug retention tang oriented substantially perpendicular to the opening on the engagement surface, the plug retention tang being positioned on the spring clip so that when the spring clip assumes a locking position the plug retention tang aligns with the opening located on the engagement surface of the receptacle.

15 Claims, 8 Drawing Sheets

UNIVERSAL SERIAL BUS (USB) CONNECTOR HAVING POSITIVE RETENTION

BACKGROUND

Connections using the Universal Serial Bus (USB) standard are becoming increasingly more commonplace and useful in computer peripheral devices, audiovisual equipment, and electronic devices in general. Such devices have advantages including a simple mechanical connection, an ability to connect and disconnect while a device is in operation ("hot plugging"), an ability to connect several devices, and a large selection of devices using this connection standard.

FIG. 1 shows an existing standard type A USB plug and receptacle. The USB receptacle 12 contains a metallic connector casing 14 having upper 16 and lower 18 surfaces, each surface having a pair of plug retention prongs 20 typically cut and formed out of the resilient metal used to manufacture the metallic connector casing 14. The plug retention prongs 20 each have a detent 22 for engaging and holding a USB plug 10. The plug retention prongs 20 on the upper surface 16 are biased downwardly toward the lower surface 18 and the plug retention prongs 20 on the lower surface 18 are biased upwardly toward the upper surface 18.

The USB plug 10 has a metallic connector body 24 connected to a cable 26 for communication with a device. The connector body 24 has an upper surface 28 and a lower surface 30. Each of the upper and lower surfaces 28 and 30 has a pair of features configured to receive the detent portion 22 of a corresponding plug retention prong 20. An example of such features are typically square surface holes 32, which are aligned with and receive the detents 22 of the plug retention prongs 20 of the USB receptacle 12 when the USB plug 10 is fully inserted into the receptacle 12.

As the USB plug 10 is inserted into the USB receptacle 12, the upper and lower plug retention prongs 20 are forced outwardly from an inner resting position to an outwardly flexed position. When the USB plug 10 is inserted to the point where the retention prongs 20 align with the surface holes 32, the plug retention prongs 20, being made of resilient material, naturally return inwardly toward an inner holding position and the detents 22 at least partially fall into the holes 32, creating a releasable snap fit which retains the USB plug 10 in the receptacle 12. Because the detents 22 of the plug retention prongs 20 are somewhat rounded, such a connection allows relatively easy insertion and removal of the USB plug 10 from the USB receptacle 12, while providing at least some resistance to disconnection.

Unfortunately, such ease of connection and disconnection creates a problem for use with certain devices where a more secure attachment is desired. In such devices, a user may wish to connect the USB device only once, and not disconnect the device unless the device is to be removed or replaced by authorized personnel. For these devices it is desired that the device remain securely attached even when subject to extreme unauthorized removal forces, and any removal means be accessible only to authorized personnel.

SUMMARY

Embodiments of a lockable connector include a receptacle having an opening located on an engagement surface and a spring clip slidably attached to the receptacle, the spring clip having a plug retention tang oriented substantially perpendicular to the opening on the engagement surface, the plug retention tang being positioned on the spring clip so that when the spring clip assumes a locking position the plug retention tang aligns with the opening located on the engagement surface of the receptacle.

Other embodiments are also provided. Other systems, methods, features, and advantages of the invention will be or become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE FIGURES

The invention can be better understood with reference to the following figures. The components within the figures are not necessarily to scale, emphasis instead being placed upon clearly illustrating the principles of the invention. Moreover, in the figures, like reference numerals designate corresponding parts throughout the different views.

DETAILED DESCRIPTION

Although described with particular reference to a specific USB connector defined by the USB specification for series A (also referred to as type A or standard type A) plugs and receptacles, embodiments of the positive retention feature of the USB connector described herein can be used with similar form factor connectors.

Figure 2:
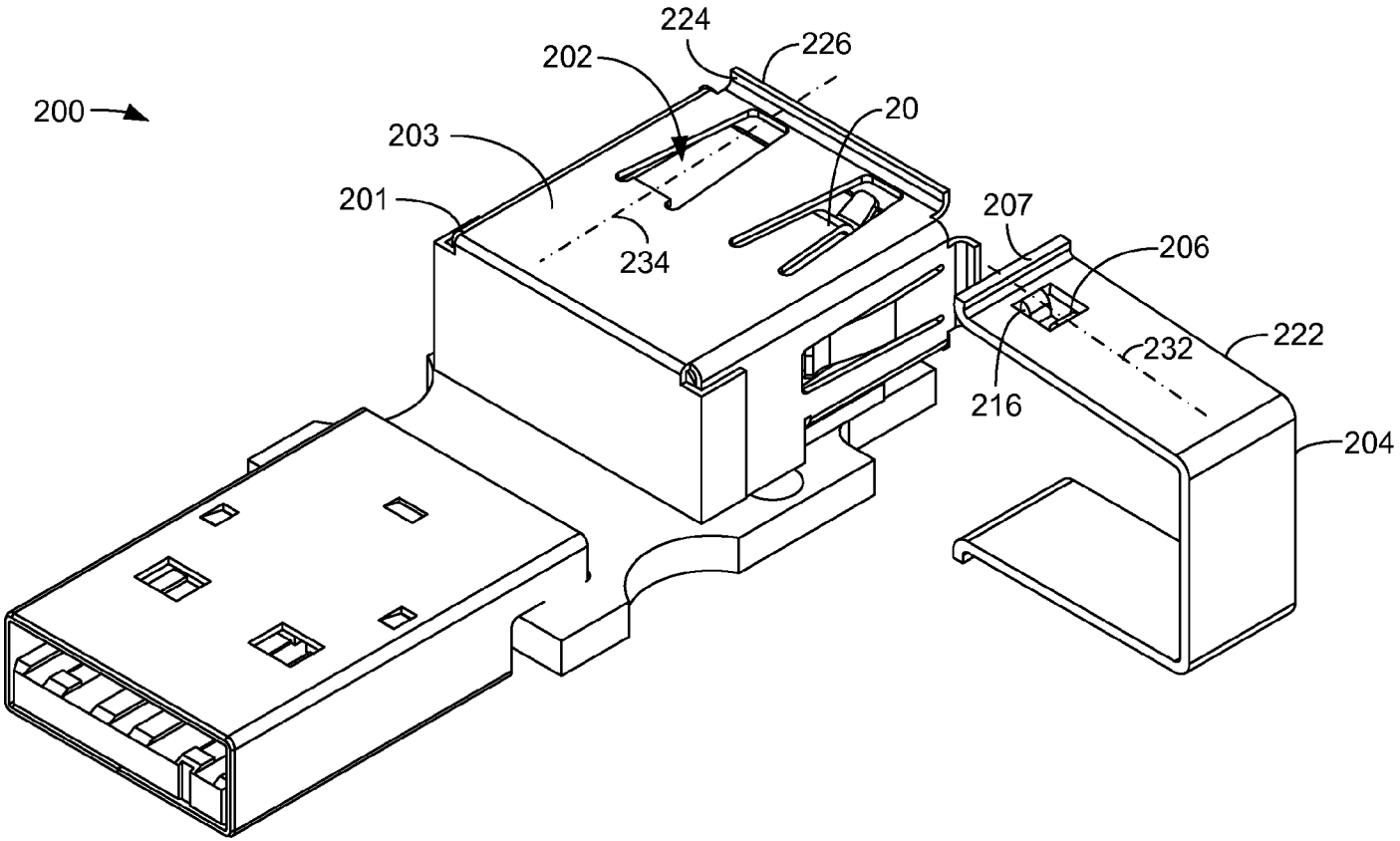
FIG. 2 is a schematic diagram illustrating an embodiment of a USB receptacle having positive retention.

FIG. 2 is a schematic diagram 200 illustrating an embodiment of a USB receptacle having a positive retention feature. A modified USB receptacle 201 includes an opening 202 formed in an engagement surface 203 of the modified USB receptacle 201. The opening 202 can be formed by removing any of the plug retention prongs 20 of a standard USB receptacle, or a modified USB receptacle 201 can be initially formed to include at least one opening 202 on any surface. Although the opening 202 is illustrated as having a shape similar to a shape of an opening having a plug retention prong 20, the opening 202 can have other shapes. Further, the engagement surface 203 can be on either side of the modified USB receptacle 201 that includes the opening 202.

Figure 1:
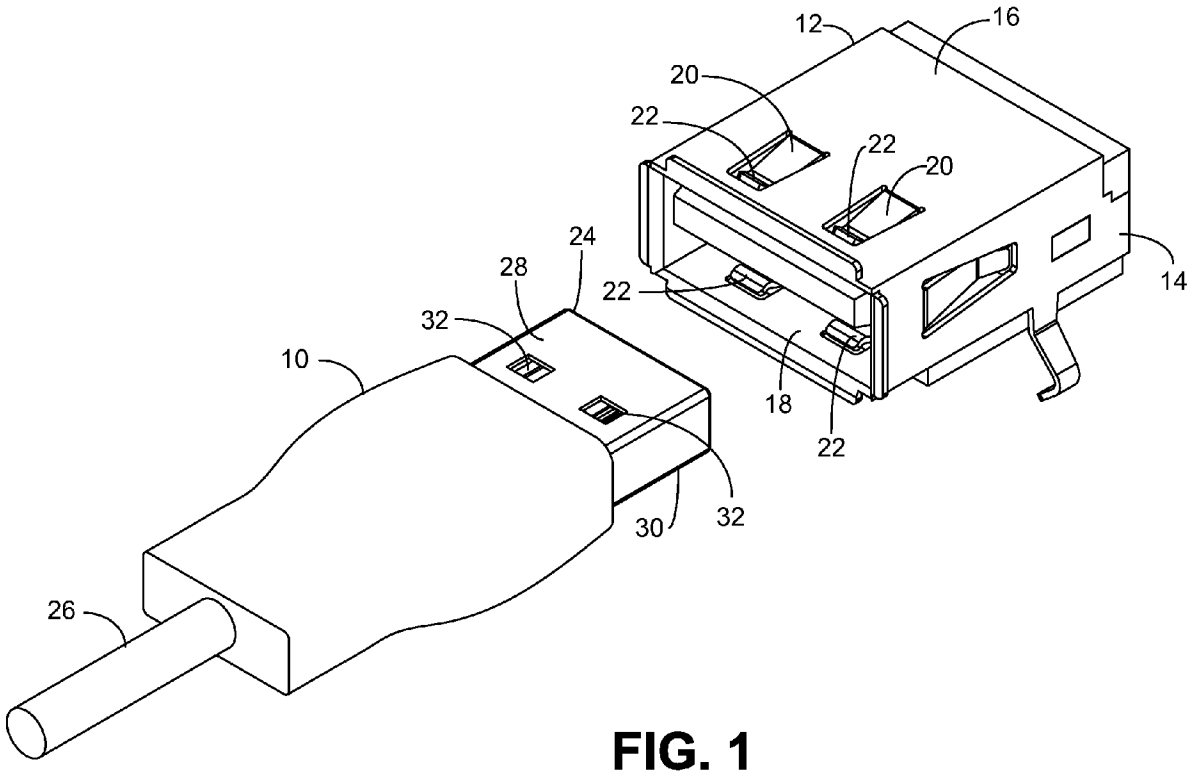
FIG. 1 (Prior Art)
FIG. 1 shows an existing USB plug and receptacle.

A spring clip 204 is associated with the modified receptacle 201 so that a plug retention tang 206 located on the spring clip 204 aligns with the opening 202. The opening 202 can be any shape adapted to receive the plug retention tang 206. The major axis 232 of the plug retention tang 206 located on the spring clip 204 is oriented generally perpendicular to the major axis of the plug retention prong 20 (FIG. 1) and generally perpendicular to the major axis 234 of the opening 202.

This orientation facilitates the installation of the spring clip 204 over the modified receptacle 201 by allowing the plug retention tang 206 and the spring clip 204 to slide over the engagement surface 203 of the modified receptacle 201 until the plug retention tang 206 drops into the opening 202 and into a corresponding opening (e.g., 32 in FIG. 1) in a mating USB plug 10 (FIG. 1) that is inserted into the modified USB receptacle 201. Due to its orientation, the plug retention tang 206 will not move upward when a USB plug 10 (FIG. 1) is pulled from the modified receptacle 201 as the plug retention tang 206 presents an immovable edge 216 to a corresponding edge of the square opening 32 in the USB plug 10.

Figure 3:
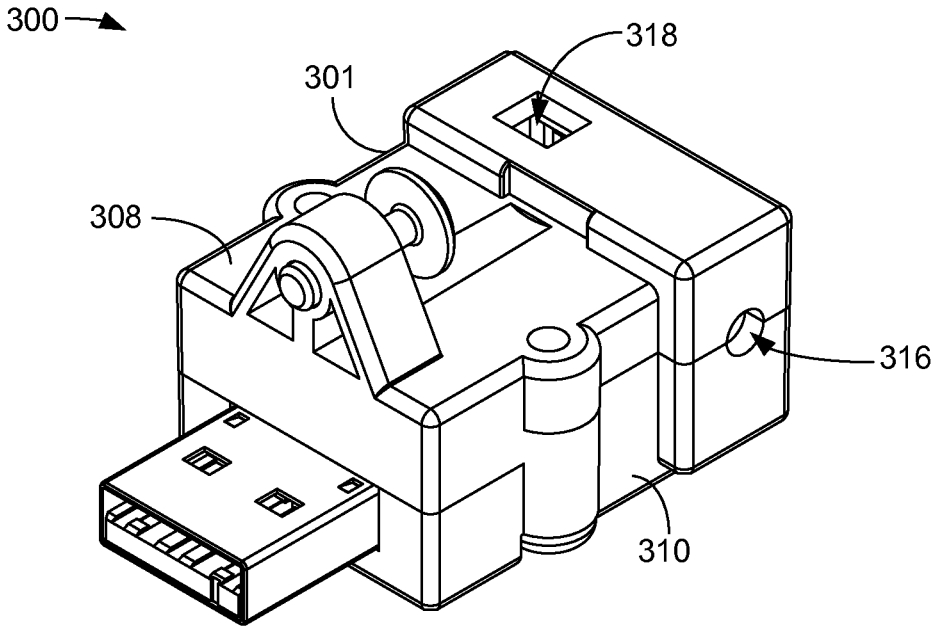
FIG. 3 is a schematic diagram illustrating a USB receptacle assembly adapted to house the modified USB receptacle of FIG. 2.
Figure 4:
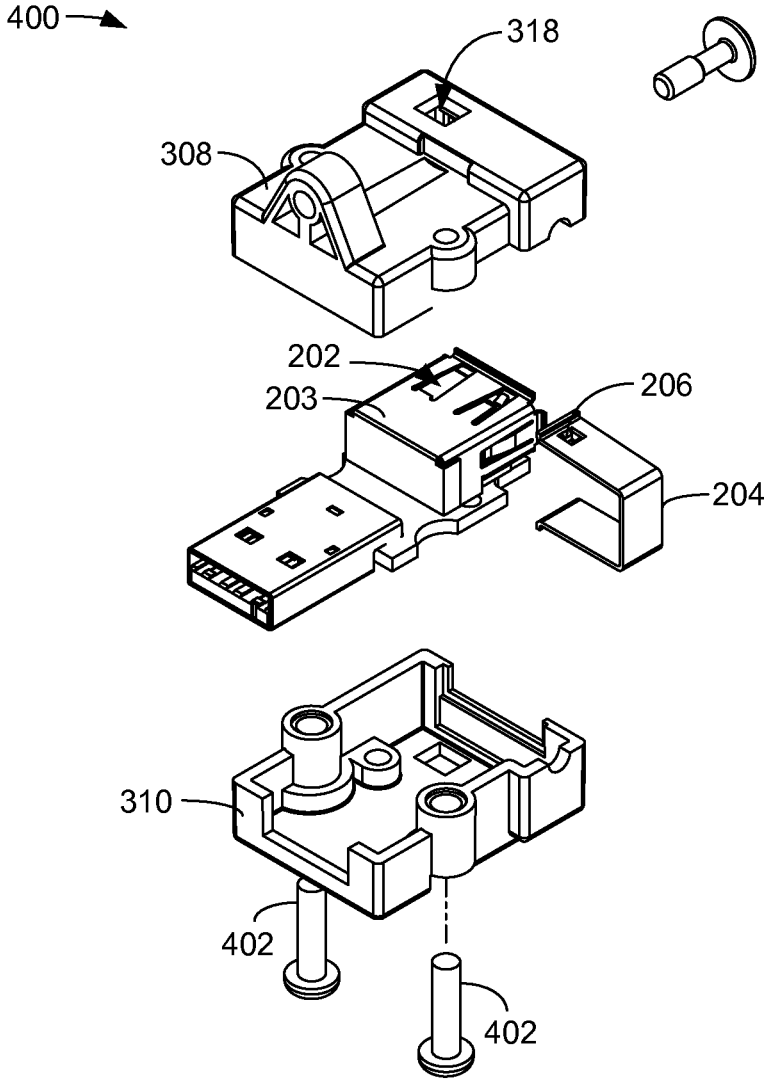
FIG. 4 is a schematic diagram illustrating an exploded view of the USB receptacle assembly of FIG. 3.
Figure 5:
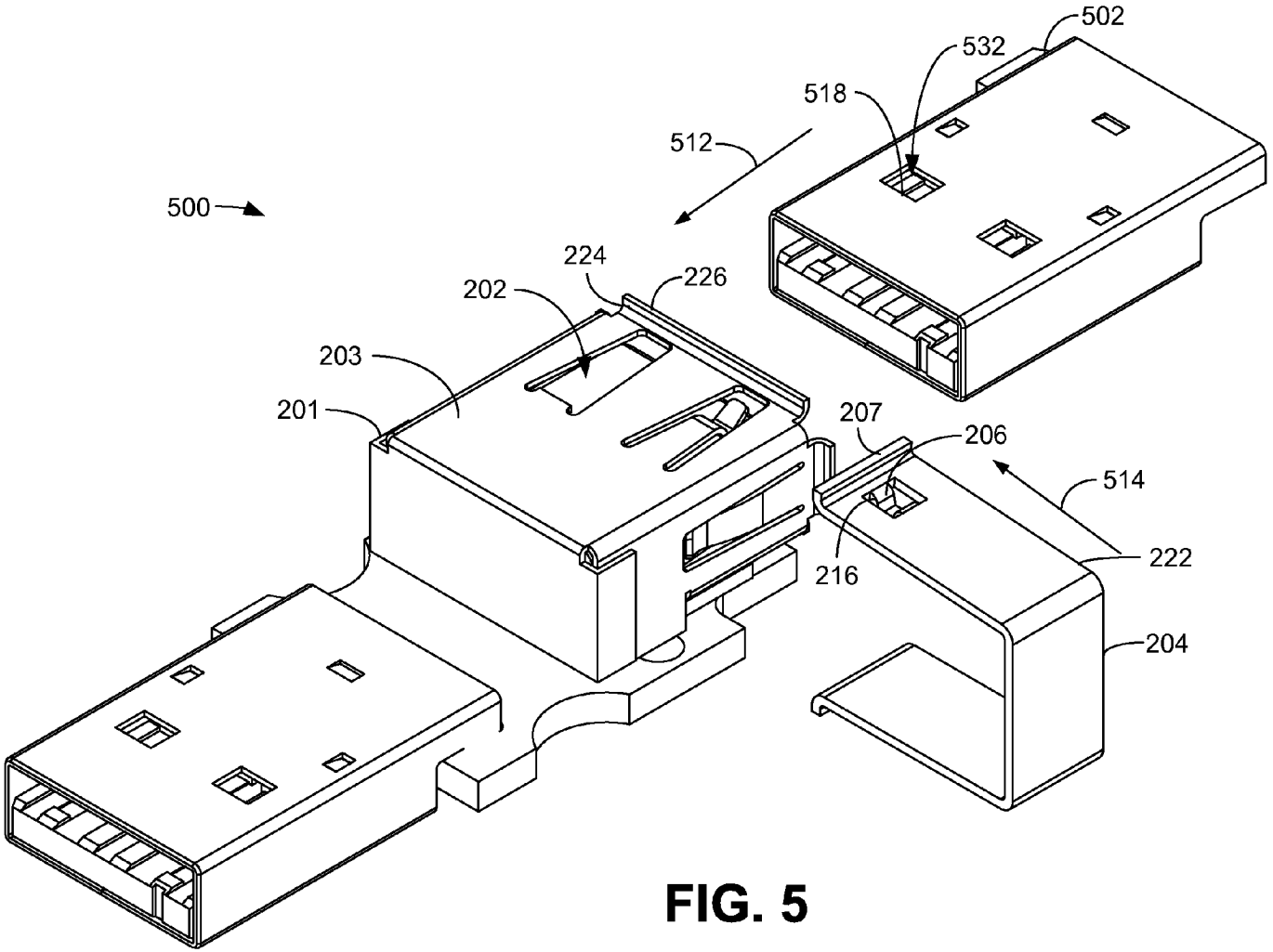
FIG. 5 is a schematic diagram illustrating the attachment of a USB plug to the USB receptacle of FIG. 2.

FIG. 3 is a schematic diagram illustrating a USB receptacle assembly 300 adapted to house the modified USB receptacle 201 of FIG. 2. FIG. 4 is a schematic diagram illustrating an exploded view of the USB receptacle assembly of FIG. 3. FIG. 5 is a schematic diagram illustrating the attachment of a USB plug to the USB receptacle of FIG. 2.

Referring to FIGS. 2, 3, 4 and 5, the spring clip 204 is attached to the modified receptacle 201 so that the plug retention tang 206 rests on the engagement surface 203, but is not yet engaged in the opening 202. To retain the spring clip 204 in place on the modified receptacle 201 and to prevent unauthorized access to the spring clip 204, a two-piece case 301, having an upper portion 308 and a lower portion 310 is attached around the modified receptacle 201 and the spring clip 204 using attachment screws 402, or any other suitable attachment means, such as, for example, adhesive, rivets, or any other attachment means. Once the USB receptacle assembly 300 is assembled together, a USB plug 502 can be inserted into the modified receptacle 201 in the direction shown by arrow 512 (FIG. 5) so that the opening 532 in the USB plug 502 aligns with and falls within a periphery of the opening 202 in the modified USB receptacle 201. After the USB plug 502 is fully inserted into the modified USB receptacle 201, to lock the USB plug 502 to the modified USB receptacle 201, a tool such as a small screwdriver or other similar tool can be inserted into the hole 316 in the case 301 and can be used to push the spring clip 204 in the direction indicated by arrow 514 so that the spring clip 204 slides across the engagement surface 203. As the spring clip 204 slides across the engagement surface 203 and reaches the opening 202, the plug retention tang 206 falls into the opening 202 and engages the opening 532 in the USB plug 502. Further, the edge 222 of the spring clip 206 can be adjacent to an edge 224 of a lip 226 formed as part of the modified USB receptacle 201. Thus, when so connected with the plug retention tang 206 engaged in the opening 202 and in the opening 532, force exerted when attempting to withdraw the USB plug 502 from the modified USB receptacle 201 will be resisted when the edge 216 of the plug retention tang 206 meets and engages the edge 518 of the opening 532, thus creating positive retention between the modified USB receptacle 201 and the USB plug 502.

In order to remove the USB plug 502 from the modified USB receptacle 201, the spring clip 204 is moved back to its initial unlocked position by inserting a tool, such as a small screwdriver or other similar tool into the opening 318 in the case 301, engaging the lip 207 of the spring clip 204, and then moving the spring clip 204 back to its initial position in the direction opposite that of arrow 514, to the unlocked position.

Figure 6:
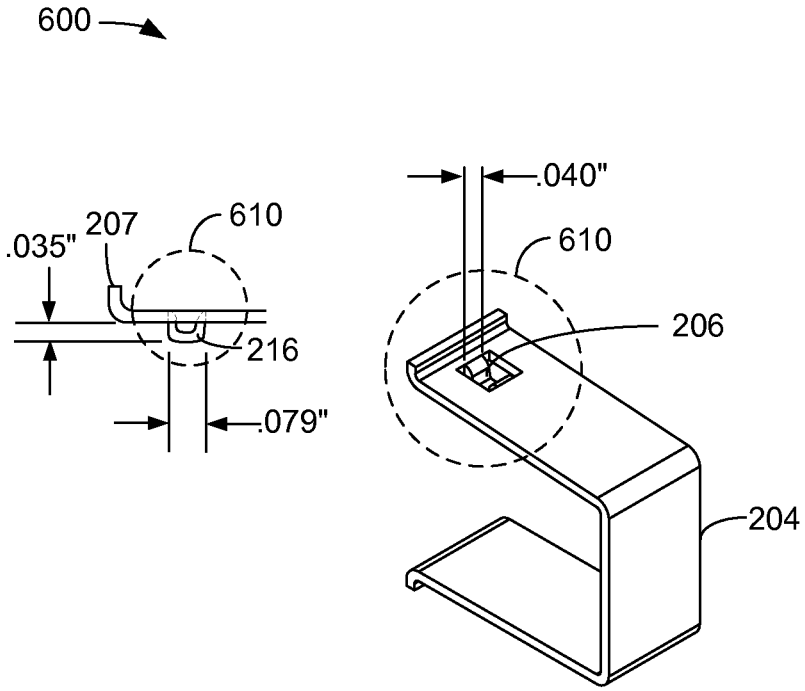
FIG. 6 is a schematic diagram illustrating the spring clip and plug retention tang of FIG. 2.

FIG. 6 is a schematic diagram illustrating the spring clip and plug retention tang of FIG. 2. The detail 610 shows an embodiment of the plug retention tang 206 having a depth of approximately 0.035" and a length of approximately 0.079". An example width is 0.040", but the width can be any width so long as the plug retention tang 206 engages the opening 532, as described herein. The dimensions shown herein are for example purposes only.

Figure 7:
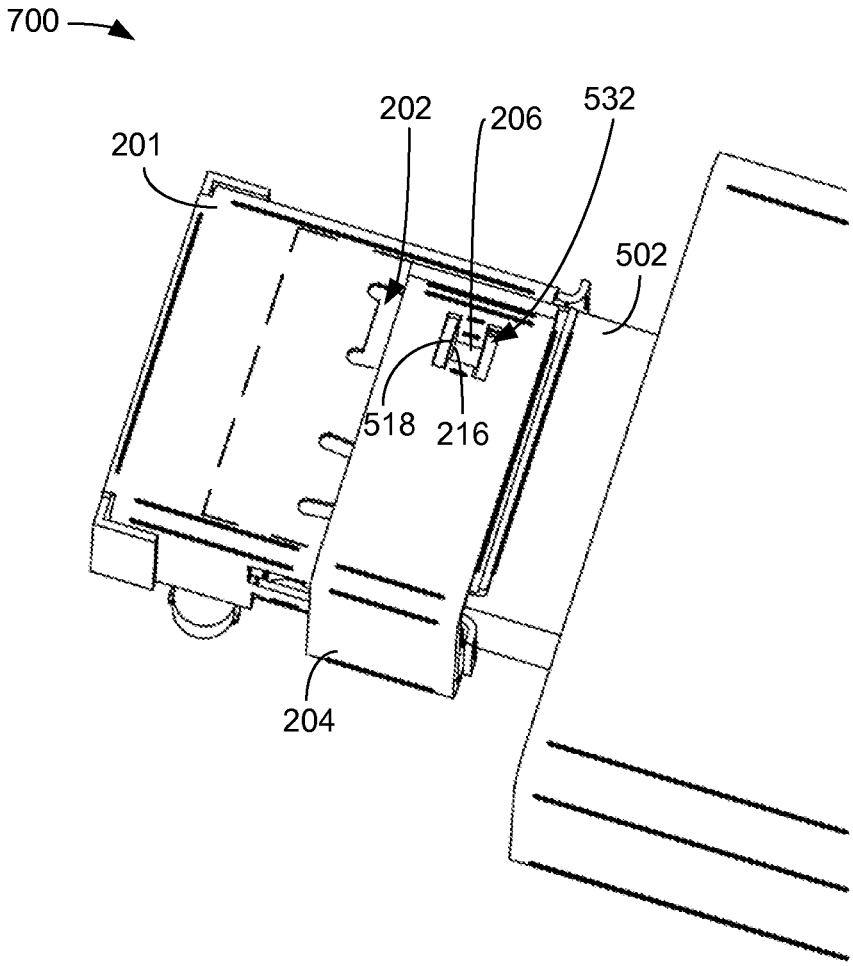
FIG. 7 is a schematic diagram illustrating the modified USB receptacle and USB plug coupled together.

FIG. 7 is a schematic diagram illustrating the modified USB receptacle 201 and USB plug 502 coupled together. When the modified USB receptacle 201 and USB plug 502 are coupled together, the opening 532 in the USB plug 502 aligns within the periphery of the opening 202 in the modified USB receptacle 201. When the spring clip 204 is moved in the direction indicated by arrow 514 (FIG. 5), the plug retention tang 206 falls into the opening 202 and engages the opening 532. Force exerted when attempting to withdraw the USB plug 502 from the modified USB receptacle 201 is resisted when the edge 216 of the plug retention tang 206 meets and engages the edge 518 of the opening 532. This engagement creates positive retention between the modified USB receptacle 201 and the USB plug 502.

Figure 8:
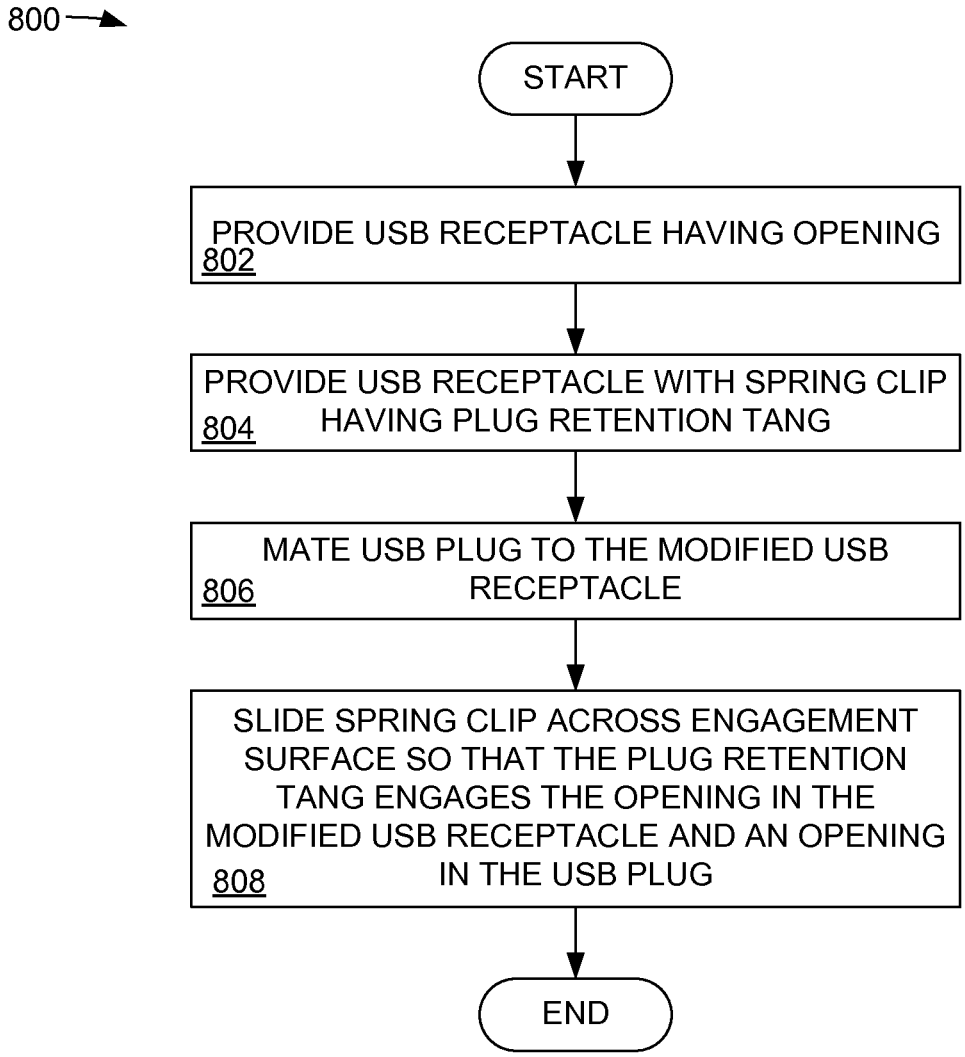
FIG. 8 is a flow chart describing the operation of an embodiment of a method for using a USB receptacle having a positive retention feature.

FIG. 8 is a flow chart describing the operation of an embodiment of a method for using a USB receptacle having a positive retention feature. The steps in the flow chart 800 can be performed in or out of the order shown, and in some instances, may be performed in parallel.

In block 802, a USB receptacle is provided to include an opening configured to receive a plug retention tang.

In block 804, the modified USB receptacle is provided with a spring clip having the plug retention tang.

In block 806, a USB plug is mated to the modified USB receptacle.

In block 808, the spring clip is caused to slide across an engagement surface of the modified USB receptacle such that the plug retention tang engages the opening in the modified USB receptacle and an opening in the USB plug.

While various embodiments of the invention have been described, it will be apparent to those of ordinary skill in the art that many more embodiments and implementations are possible that are within the scope of this invention.

What is claimed is:

1. A lockable connector receptacle, comprising:

a series A universal serial bus (USB) receptacle, the receptacle having an opening located on an engagement surface; and a spring clip slidably attached to the receptacle, the spring clip having a plug retention tang oriented substantially perpendicular to the opening on the engagement surface, the plug retention tang being positioned on the spring clip so that when the spring clip assumes a locked position the plug retention tang aligns with the opening located on the engagement surface of the receptacle.

2. The receptacle of claim 1, wherein when a mating plug is located in the receptacle, at least one opening in the mating plug aligns with the opening located on the engagement surface of the receptacle such that the plug retention tang engages the opening in the mating plug.

3. The receptacle of claim 2, wherein an edge of the plug retention tang engages an edge of the opening in the mating plug.

4. The receptacle of claim 1, further comprising a housing over the receptacle and the spring clip, the housing comprising a first access hole adapted to allow the insertion of a tool to engage and move the spring clip to the locked position.

5. The receptacle of claim 4, wherein the housing further comprises a second access hole adapted to allow the insertion of a tool to disengage and move the spring clip to an unlocked position.

6. A series A universal serial bus (USB) connector having positive retention, comprising:

a series A USB receptacle, the series A USB receptacle having an opening located on an engagement surface;

a spring clip slidably attached to the series A USB receptacle, the spring clip having a plug retention tang oriented substantially perpendicular to the opening on the engagement surface, the plug retention tang being positioned on the spring clip so that when the spring clip assumes a locked position the plug retention tang aligns with the opening located on the engagement surface of the series A USB receptacle; and a series A USB plug located in the receptacle, the series A USB plug having at least one opening such that the at least one opening in the series A USB plug aligns with the opening located on the engagement surface of the series A USB receptacle such that the plug retention tang engages the opening in the mating plug.

7. The USB connector of claim 6, wherein an edge of the plug retention tang engages an edge of the opening in the series A USB plug.

8. The USB connector of claim 6, further comprising a housing over the receptacle and the spring clip, the housing comprising a first access hole adapted to allow the insertion of a tool to engage and move the spring clip to the locked position.

9. The USB connector of claim 8, wherein the housing further comprises a second access hole adapted to allow the insertion of a tool to disengage and move the spring clip to an unlocked position.

10. A method for using a connector receptacle having positive retention, comprising:

providing a series A universal serial bus (USB) receptacle having an opening configured to receive a plug retention tang, the opening on an engagement surface;

providing a spring clip associated with the series A USB receptacle, the spring clip having the plug retention tang oriented substantially perpendicular to the opening on the engagement surface, the plug retention tang being positioned on the spring clip so that when the spring clip assumes a locked position the plug retention tang aligns with the opening located on the engagement surface of the series A USB receptacle;

mating a series A USB plug with the receptacle, the series A USB plug having at least one opening such that the at least one opening in the series A USB plug aligns with the opening located on the engagement surface of the series A USB receptacle such that the plug retention tang engages the opening in the mating plug; and causing the plug retention tang on the spring clip to engage the opening in the receptacle and the opening in the plug.

11. The method of claim 10, wherein associating the spring clip with the receptacle comprises slidably coupling the spring clip to the receptacle.

12. The method of claim 11, wherein slidably coupling the spring clip to the receptacle allows the spring clip to engage and disengage the opening in the receptacle and the opening in the plug using a tool.

13. A lockable connector receptacle, comprising:

a receptacle, the receptacle having an opening located on an engagement surface;

a spring clip slidably attached to the receptacle, the spring clip having a plug retention tang oriented substantially perpendicular to the opening on the engagement surface, the plug retention tang being positioned on the spring clip so that when the spring clip assumes a locked position the plug retention tang aligns with the opening located on the engagement surface of the receptacle;

wherein when a mating plug is located in the receptacle, at least one opening in the mating plug aligns with the opening located on the engagement surface of the receptacle such that an edge of the plug retention tang engages an edge of the opening in the mating plug; and a housing over the receptacle and the spring clip, the housing comprising a first access hole adapted to allow the insertion of a tool to engage and move the spring clip to the locked position.

14. The receptacle of claim 13, wherein the receptacle is a universal serial bus (USB) series A receptacle.

15. The receptacle of claim 13, wherein the housing further comprises a second access hole adapted to allow the insertion of a tool to disengage and move the spring clip to an unlocked position.

* * * * *